United States Patent [19]

Lerman

[11] 4,062,143

[45] Dec. 13, 1977

[54] BUBBLE GENERATOR

[75] Inventor: Victor S. Lerman, Malden, Mass.

[73] Assignee: Amalgamated Enterprises, Malden, Mass.

[21] Appl. No.: 713,929

[22] Filed: Aug. 12, 1976

[51] Int. Cl.[2] ..... A63H 33/28

[52] U.S. Cl. ..... 46/6

[58] Field of Search ..... 46/5, 6, 7

[56] References Cited

U.S. PATENT DOCUMENTS

| | | | |
|---|---|---|---|
| 2,805,515 | 9/1957 | Gans et al. | 46/7 |
| 3,626,631 | 12/1971 | Lerman | 46/7 |

*Primary Examiner*—Louis G. Mancene
*Assistant Examiner*—Robert F. Cutting
*Attorney, Agent, or Firm*—Wolf, Greenfield & Sacks

[57] ABSTRACT

An improved bubble generator. A bubble ring supported centrally in an air tube is wet by a bubble forming liquid flowing from the hollow interior of the ring through holes of approximately 0.031 inches in diameter. Mounting means attach the bubble generator to a bicycle, motion of which provides an air flow through an air tube which generates the bubbles. The generation of bubbles is controlled by movement of a priming pad into and out of engagement with the bubble ring. The movement of the pad is effected by an arm, on one end of which the pad is mounted and the other end of which is attached to a pivot. A rigid lever means actuates the movement of the arm about the pivot. The pivot comprises a plate attached to the under side of the air tube and having an arcuate identation, a yoke which fits over the pivot plate and an axle which is fixed across the yoke and rotates in the arcuate indentation. A bias means such as a rubber band holds the yoke and axle in place and returns and holds the priming pad against the ring when the actuating lever is released, thereby terminating the bubble generation.

8 Claims, 6 Drawing Figures

Fig. 1
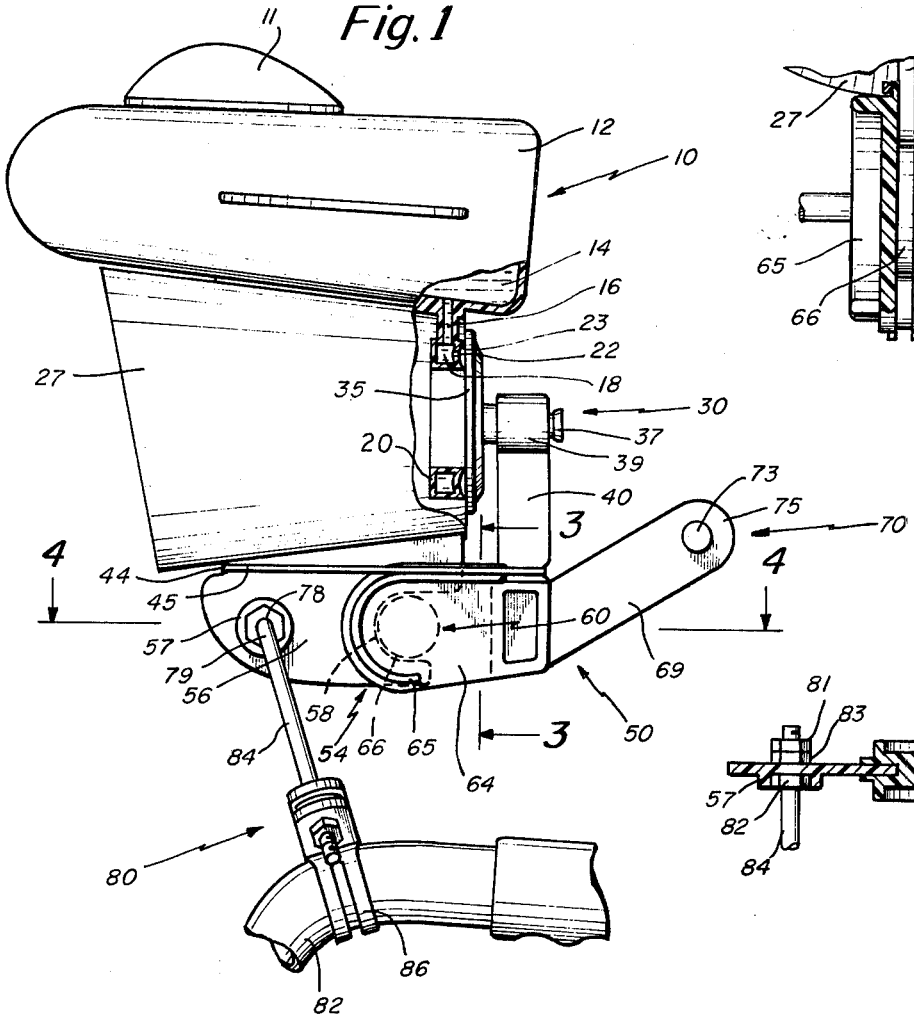
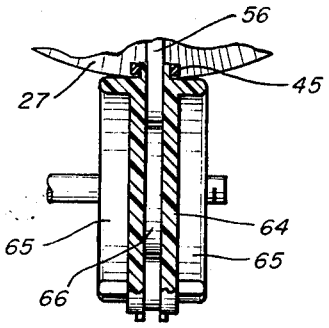
Fig. 3
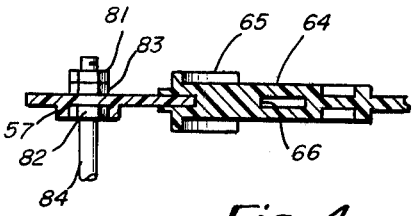
Fig. 4
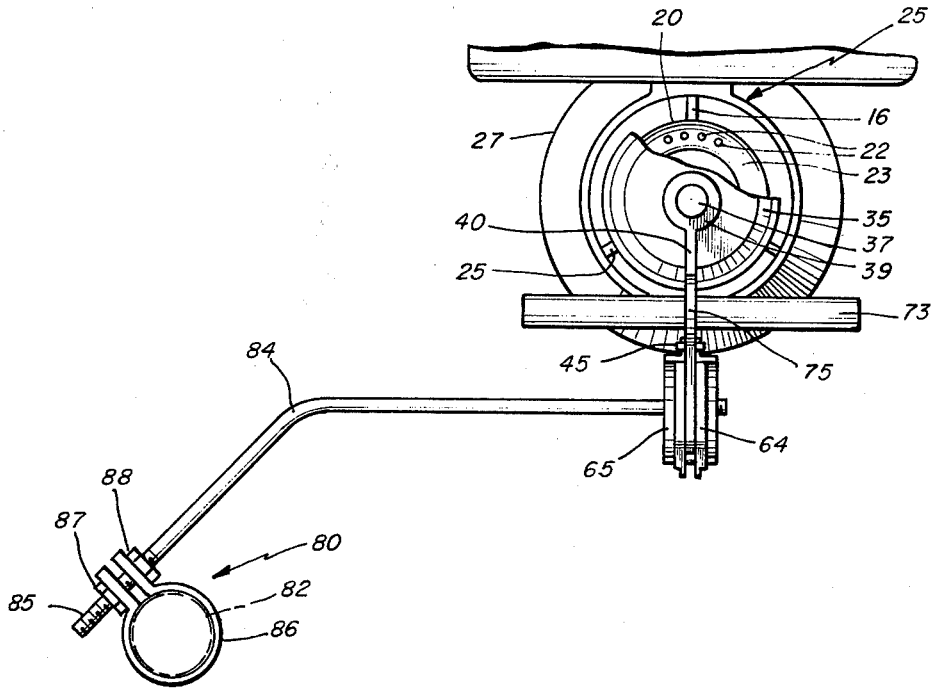
Fig. 2

BUBBLE GENERATOR

BACKGROUND OF THE INVENTION

This invention relates to bubble generating devices and more particularly to an improved device for generating a continuous stream of bubbles in response to a continuous flow of air. This bubble generator, which may be used as an amusement device on a bicycle in which a bubble stream is generated in response to the forward movement of the bicycle, is an improvement of previously patented bubble generating device, U.S. Pat. No. 3,626,631.

The previously patented bubble generator comprises a hollow bubble generating ring which is mounted in a fixed position at the rear and center of an air tube and lies in a plane that is substantially normal to a stream of air which flows through that air tube. The hollow of the ring is in direct communication with a tank of film-forming liquid. The tank is mounted on the top of the air tube. The rear or downstream face of the ring has a plurality of holes which permit the fluid to flow from the tank through the hollow in the ring and out onto the downstream face of the ring to form a thin film over the opening defined by the ring. The air flowing through the ring forms the film into bubbles.

The air flow necessary for the operation of the patented device may be generated by attaching the device to a bicycle, aligning it appropriately, and propelling the bicycle forward. Thus it is important that a means be provided for easily attaching and aligning the device on a bicycle.

The rear face of the ring in the patented device is preferably concave which, as described in the above cited application, is effective in inducing the flow of soapy fluid from the overhead tank in response to the air flowing through and about the bubble generating ring. In addition, the air tube may be tapered toward the rear which increases the speed of the air as it approaches the ring which in turn enhances the flow of the liquid out through the holes in the ring. Of course, the location of the tank atop the air tube also tends to enhance the liquid flow. These properties of the patented device ensure a continuous flow of the liquid out over the ring while the air flow is maintained, however, ultimately the speed and quantity of the flow will be determined by the size and number of the holes. If the holes are too small, the flow may be retarded to the point where formation of the bubbles is difficult; if the holes are too large, the liquid may be unnecessarily wasted and the enjoyment of the device may be decreased by the necessity for frequent refilling of the tank. Thus, it is important that the optimum size and number of the holes be determined for a given bubble forming liquid.

In the previously patented device, the generation of bubbles is controlled by means of a priming pad which is mounted on a pivot arm and can be moved into and out of engagement with the downstream face of the bubble ring. When the generator is not operating, a biasing means, such as a rubber band, hold the priming pad against the bubble ring covering the holes and preventing the flow of bubble forming liquid. When the priming pad is pivoted away from the bubble ring while the device is in forward motion, the air stream flowing by and through the bubble ring creates a continuous flow of bubbles. In the patented device, the movement of the priming pad is effected by means of a string attached to the pivot arm. The string has the disadvantages that it may become tangled and/or the air stream flow may move it from side to side so that it is not always readily graspable and the user often must visually find the string when he or she decides to activate the bubble generator. Thus, a rigid lever system that could be operated by touch alone would be highly desireable in a bubble generator.

In the patented bubble generator, the priming pad pivoting mechanism is the only moving part. Thus, if this mechanism could be made more durable and at the same time be easy to manufacture, assemble, and operate, the useful life of the bubble generator would be extended and the commercial value and profitability would be considerably enhanced.

Accordingly, it is an object of the present invention to provide an improved bubble generator.

It is a further object of the present invention to achieve the preceding object in a bubble generator that can be mounted and properly aligned for operation on a bicycle.

It is another object of the present invention to achieve one or more of the preceding objects with a bubble generator in which the economy and duration of operation are at the maximum level consistent with effectiveness of bubble formation.

It is another object of the present invention to achieve one or more of the preceding objects with a bubble generator in which the number and size of the holes in the bubble ring are optimized.

It is yet another object of the invention to achieve one or more of the preceding objects in a bubble generator that can be easily activated by a bicycle rider while the bicycle is in motion.

It is a further object of this invention to achieve one or more of the preceding objects in a bubble generator that can be activated by touch alone.

It is yet another object of the invention to achieve one or more of the preceding objects in a bubble generator in which the priming pad pivoting mechanism is durable and is easy to manufacture, assemble, and operate.

SUMMARY OF THE INVENTION

According to the invention, a device for generating bubbles from a film-forming liquid comprises: a ring adapted to be wetted by the film-forming liquid and to support the liquid in a film across the opening defined by the ring; a frame for supporting the ring in a position in which a stream of air may be directed toward the ring along a path substantially normal to the plane in which the ring supports the film, whereby the air stream may cause the film to be blown into a bubble and discharged downstream from the ring; supply means for communicating the liquid to the ring; priming means for including a pad adapted to be wetted by the liquid; and a rigid lever means to effect the movement of the pad into and out of engagement with the downstream side of the ring. Preferably, the priming pad is mounted on a pivoted first arm. Preferably, the lever means comprises a rod secured to the distal end of a second pivoted arm adapted so that when the lever is actuated, the priming pad moves away from the ring. Alternatively, the pivoted motion of the first arm may be obtained by means of an axle secured to the arm near its pivoted end and extending away from the arm in a direction substantially perpendicular to the plane in which the arm pivots, and a trigger attached to the axle means near its free end and lying in a plane substantially parallel to the plane in which the arm pivots so that pulling on the trigger rotates the axle and pivots the arm. Preferably, a biasing means, such as a rubber band, urges the arm pivotally toward the bubble ring and releasably holds the pad in engagement with the ring.

Alternatively, the device for generating bubbles as described above includes an improved pivoting means comprising a bearing means attached to the frame, lying substantially in the pivoting plane and having an arcuate indentation; a yoke adapted to fit over the bearing means; and an axle means disposed across the yoke and having substantially the same radius as the indentation. The axle means is secured to the yoke so that when the yoke is fitted over the bearing means with the axle located within the indentation, the yoke means may rotate about the indentation with the axle member rotably slipping against the perimeter of the indentation to provide the pivotal movement.

Preferably, the first arm for pivoting the priming pad into and out of engagement with the ring is attached to the yoke and has a slot in the edge of the arm oriented away from the bearing means. Preferably, the bearing means has a slot oriented away from the arm. A biasing means, such as a rubber band, is preferably positioned over the arm and the bearing means and fitted into the slots in a slightly tensed configurment so that it urges the axle member into the indentation, urges the arm pivotally toward the bubble ring, and releasably holds the pad in engagement with the ring.

Alternatively, a device for generating bubbles in any of the modes described above may include the improvement comprising a mounting means whereby the device may be fastened to a rigid bar such as the handlebars of a bicycle.

Preferably, in any of the modes of the bubble generating device described above, the ring is hollow and has a concave downstream face, the supply means communicates with the hollow ring, and the hollow of the ring communicates with the downstream side of the ring through a plurality of holes through which the liquid may flow toward the ring. Preferably, there are four holes in the ring, each being 0.031 inches in diameter. Preferably, the bubble generation device, in any of the modes described above, also includes means elevating the supply means above the ring and the holes are located in the upper region of the ring so that the liquid may flow gravitationally and continuously towards the ring when the priming means is disengaged from the ring.

Numerous other features, objects, and advantages of the invention will now become apparent from the following detailed description when read in conjunction with the accompanying drawing, in which:

BRIEF FIGURE DESCRIPTION

FIG. 1 is a side view of the preferred embodiment of the invention attached to a bicycle handlebar showing air tube and supply tank partially cut away to expose the bubble generating ring and the supply tube;

FIG. 2 is a rear view of the preferred embodiment of the invention showing the priming pad partially cut away to expose the rear face of the bubble generating ring and the holes located therein;

FIG. 3 is a cross sectional view of the pivoting mechanism taken through line 3—3 of FIG. 1;

FIG. 4 is a cross sectional view of the pivoting mechanism taken through line 4—4 of FIG. 1;

DETAILED DESCRIPTION OF THE PREFERRED EMBODIMENT

Figure 5:
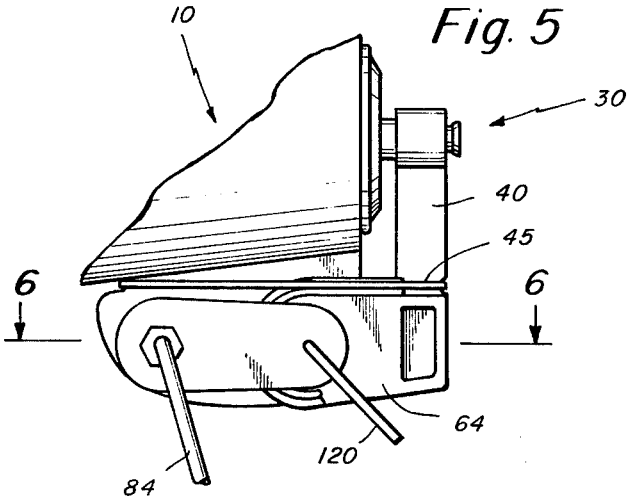
FIG. 5 is a side view of a portion of an alternative embodiment of the invention.

Referring to the drawing and in particular to FIGS. 1 through 4, there is shown the preferred embodiment of the invention attached to bicycle handlebars 82. As shown, priming means 30 is in engagement with bubble generating ring 20. If while the bicycle is in motion operating means 50 is depressed disengaging priming means 30 from ring 20, liquid 14 flows from supply means 10 and forms a film over ring 20 from which film air flowing from air tube 27 generates a continuous stream of bubbles.

The supply means shown generally at 10 includes a storage tank 12 containing a bubble forming liquid 14, and a supply tube 16 which communicates with tank 12 and with a hollow 18 in bubble generating ring 20. Tank 12 is filled with liquid 14 through an opening covered by cap 11. Tank 12 also has a small vent hole (not shown) to maintain the pressure inside the tank equal to the ambient atmosphere. Holes 22 in the downstream surface 23 of bubble generating ring 20 communicates with hollow 18. Frame 25 supports and positions ring 20 and the center of the rear or downstream end of air tube 27.

The priming means, shown generally at 30, comprises a sealing pad 35 and operating means, shown generally at 50. The operating means 50 comprises first arm 40, secured to pivoting means, shown generally at 60, and lever means, shown generally at 70. Securing means 37 fastens pad 35 to the distal end 39 of arm 40. The details of the construction and operation of priming pad 35 and securing means 37 are described in U.S. Pat. No. 3,626,631.

Pivoting means 60 comprises a bearing means, shown generally at 54, a yoke 64 (forming part of arm 40), and an axle means 66. Bearing means 54 preferably comprises a planar member 56 having an arcuate indentation 58. Axle 66 is disposed across and secured to yoke 64 and yoke 64 fits over planar member 56 with axle 66 located within indentation 58.

Lever means 70 preferably comprises a second arm 69 fixed to yoke 64 and having a rod 73 secured to its distal end 75.

The bubble generator also preferably includes a biasing means which preferably is a rubber band 45. Biasing means 45 fits over arm 40 and planar member 56 in slots 44 and 46 in a slightly tensed configuration. Rubber band 45 acts as a means for urging axle 66 into indentation 58 and as a means for releasably urging priming means 30 into engagement with ring 20.

The bubble generator also includes a mounting means shown generally at 80 by which it may be fastened to a rigid bar 82 such as a bicycle handlebar. Mounting means 80 preferably includes a rod 84 threaded at both ends, one end 79 of which passes through an opening 78 in planar member 56 and is secured to planar member 56 by means of nuts 81, 82, and washer 53. Opening 78 preferably has a raised rim 57 which is preferably adapted so that nut 82 seats snugly within it. The other end 85 of rod 84 passes through clamp 86 which is tightened by means of nuts 87 and 88, thereby securing rod 84 to bar 82.

Figure 6:
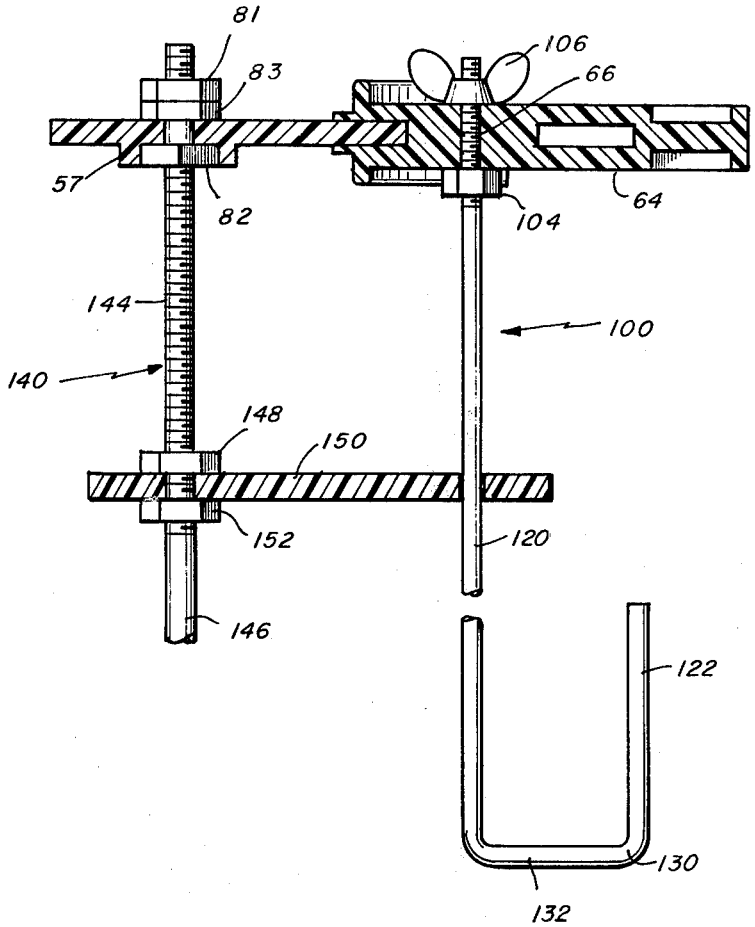
FIG. 6 is a cross sectional view of the alternative embodiment of the invention taken through line 4—4 of FIG. 3.

An alternative embodiment of the invention is shown in FIGS. 5 and 6. Supply means 10, priming means 30 and biasing means 45 are as described above, however, lever means 100 comprises axle 120 and trigger 130. Axle 120 is preferably threaded at end 118 and passes axially through yoke 64 (which forms the lower end arm 40) and axle 66 and is securely fastened to yoke 64 and axle 66 by means of nut 104 and wing nut 106. Free end 122 of axle 120 is bent to form trigger 130. Mounting means 140 is as described above except that threads 144 are preferably extended further along rod 146. Bracket 150 is secured to rod 146 by nuts 148 and 152. Bracket 150 acts as a support for axle 120 which passes through the bracket but is free to rotate in it.

The bubble generator is operated by causing an air stream to move through air tube 27, for example by mounting it on a bicycle and by propelling the bicycle forward, and at the same time, pushing down on rod 73 (FIG. 1) so that priming means 30 rotates in the plane of the page, thereby pivoting pad 35 out of engagement with ring 20. Rod 73 preferably is perpendicular to the plane of rotation, however generally it may point in any direction which still permits the user to gain sufficient leverage to depress it. In the alternative embodiment (FIG. 4) priming means 30 is rotated out of engagement with ring 20 by pressing on trigger 130. Trigger 130 preferably has a portion 132 that is parallel to the plane of rotation of arm 40 and priming means 30. Again, however, trigger portion 132 may point in any direction which provides the appropriate leverage to activate the operating means 50.

In both embodiments of the invention shown, the generation of bubbles is stopped by releasing the lever means whereupon biasing means 45, preferably comprising an elasticized endless band, urges arm 40 toward ring 20 so that pad 35 engages the ring and stops the bubble flow. Biasing means 45 is preferably tense slightly so that it releasably holds pad 35 in engagement with ring 20 when generation of bubbles is not desired.

Pivoting means 60 is an important feature of the invention. As described above, yoke 64, axle 66, and planar member 56 are constructed so that yoke 64 fits over planar member 56 with axle 66 located in arcuate indentation 58. The radii of indentation 58 and axle 66 are substantially equal; i.e., the radii are such that axle 66 fits snugly into indentation 58 but is free to rotatably slip against the perimeter of indentation 58. Preferably, yoke 64 has a raised rim 65 which contacts biasing means 45 as the yoke rotates downwards so that the biasing force always acts through a line above axle 66, as the biasing force would act to pivot the priming means in the opposite direction (clockwise in the drawing) if the line of force dropped below the axle. Note that biasing means 45 not only urges sealing pad 35 toward ring 20 as described above but also urges axle 66 into indentation 58. Thus, no hardware other than biasing means 45 is required to hold the parts of the operating means 50 in correct position and alignment. Thus, the number of pieces required to be manufactured is reduced as well as the number of assembling operations. In fact, the device can easily be assembled by the consumer. The relatively large size of axle 66 and indentation surface on which it rotates makes a pivoting means 54 very durable and easy to operate.

Another feature of the invention is the size and number of holes 22. In the previous patent, the contributions of the elevated supply means 10, concave ring surface 18 and constricted air tube 27 to the proper flow of the bubble forming fluid is described. The number and size of holes 22 are also important for determining the fluid flow. It has been found that four holes 22, approximately 0.031 inches in diameter, yield an appropriate fluid flow rate when the fluid is a glycerine base liquid or a soap and water solution. This number and size of holes permits proper amounts of film-forming fluid to reach the downstream surface of the bubble generating ring so that when a user causes air to pass through the air tube at a suitable speed, bubbles will be frequently and continuously generated from the ring. In addition, this number and size of holes also regulates the flow so that 8 ounces of film-forming fluid (which preferably is the amount the storage tank 12 holes) will last for 12 to 15 minutes of continuous use.

Mounting means 80 permits the bubble generator to be properly aligned and secured to a bicycle so that when the bicycle is propelled forward, air enters the wide end and exits at the narrower end of air tube 27. The user fastens mounting means 80 to the bicycle handlebar 82 by slipping the loosened clamp 86 over the handlebar, inserting rod 84 through the holes in the clamp, properly aligning the bubble generator, and then tightening nuts 87 and 88 to secure rod 84 in fixed position relative to handlebar 82. Air tube 27 may then be aligned along a horizontal axis and secured in place by tightening nut 81. Note that nut 82 is prevented from rotating due to its close fit in the interior of raised rim 57. Raised rim 57 also serves to strengthen the area of attachment of mounting means 80.

Mounting means 80 and lever means 100 (FIG. 6) are preferably composed of metal, however may also be composed of plastic or any other suitable material. Elastic band 45 and the surface of pad 35 are preferably composed of rubber, however other elastic materials are suitable. The rest of the bubble generator is preferably composed of plastic, however, metal or any other suitably rigid and economical material may be used.

There has been described an improved bubble generator characterized by durability, economy, and ease of operation and having numerous other features. It is evident that those skilled in the art may now make numerous uses, modifications of, and departures from the specific embodiment described herein without departing from the inventive concepts. For example, the bubble generator may be made in a wide variety of sizes, and out of a wide variety of materials. The optimum hole size and number given are for a bubble generator having a bubble generating ring 20 approximately 1 inch in outside diameter. With other diameter bubble rings, appropriate adjustments to hole size and number may be made. Similarly, the bubble generator specifications may be adapted to provide optimum operation with bubble forming liquids other than a glycerine based liquid or soap water. The lever means (70 and 100) may be made in a wide variety of configurations without departing from the rigid lever concept; just one alternative arrangement might be, for example, to secure rod 73 to arm 40 rather than utilizing the second arm 69. Likewise, many configurations of the mounting means 80 may be substituted which attach not only to handlebars but to other parts of the bicycle as well. Consequently, the invention is to be construed as embracing each and every novel feature and novel combination of features present in or possessed by the apparatus herein disclosed.

What is claimed is:

1. In a device for generating bubbles comprising a ring across which a liquid film may be formed, means for directing a flow of air through said ring for forming a stream of bubbles from said film, and a priming means selectively engageable with said ring for priming said ring for formation of said bubbles, the improvement comprising means pivotally supporting said priming means for movement to and from engagement with said ring, and a lever means rigidly engaged with said means pivotally supporting said priming means for operative control thereof.

2. A device as set forth in claim 1 wherein said lever means includes an arm extending radially from said pivotal support means and means extending rigidly from and angular to said arm at a point remote from said pivotal support means for hand engagement and control of said lever means.

3. A device as set forth in claim 1 wherein said lever means is integrally formed with said pivotal support means and includes an arm extending radially from said pivotal support means, and means extending rigidly from and angular to said arm at a point remote from said pivotal support means.

4. A device as set forth in claim 3 including means for securing said device comprising a bracket having a rod with a clamp at one end and means securing said rod at the other end to said device, said rod extending generally parallel to said means extending from said arm.

5. A device as set forth in claim 1 wherein said lever means includes axle means extending from said pivotal support means and trigger means extending rigidly from and angular to said axle means for hand engagement and pivotal control of said lever means.

6. A device as set forth in claim 1 wherein said ring is hollow with a concave downstream face and with a plurality of holes extending through the wall of said ring from the interior of said concave downstream face, said holes having a diameter of approximately 0.031 inches.

7. A device as set forth in claim 6 wherein said ring has at least four holes formed therein.

8. A device as set forth in claim 7 wherein said ring has four holes formed therein.

* * * * *